US007230586B1

(12) United States Patent
Kang et al.

(10) Patent No.: US 7,230,586 B1
(45) Date of Patent: Jun. 12, 2007

(54) RADIO FREQUENCY PLASMA DISPLAY PANEL AND FABRICATING METHOD THEREOF AND DRIVING APPARATUS THEREFOR

(75) Inventors: Jung Won Kang, Seoul (KR); Woo Gon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 596 days.

(21) Appl. No.: 09/597,553

(22) Filed: Jun. 19, 2000

(30) Foreign Application Priority Data

Jun. 18, 1999 (KR) ..... P99-22981
Aug. 11, 1999 (KR) ..... P99-32892

(51) Int. Cl.
*G09G 3/28* (2006.01)

(52) U.S. Cl. ..... 345/60; 345/66; 345/67

(58) Field of Classification Search ..... 345/60–72, 345/74.1, 76, 204, 214; 315/167, 168, 169.1, 315/169.4; 313/484, 491, 514, 517, 520
See application file for complete search history.

(56) References Cited

U.S. PATENT DOCUMENTS 5,967,872 A * 10/1999 Betsui et al. ..... 445/24
5,991,416 A * 11/1999 Bae ..... 380/39
6,097,357 A * 8/2000 Shinoda et al. ..... 345/63
6,100,641 A * 8/2000 Baranov et al. ..... 315/169.4
6,104,362 A * 8/2000 Kuriyama et al. ..... 345/63
6,262,532 B1 * 7/2001 Park et al. ..... 313/585
6,271,810 B1 * 8/2001 Yoo et al. ..... 345/60
6,340,866 B1 * 1/2002 Yoo ..... 315/169.3

* cited by examiner

*Primary Examiner*—Richard Hjerpe
*Assistant Examiner*—Mansour M. Said
(74) *Attorney, Agent, or Firm*—Ked & Associates, LLP

(57) ABSTRACT

A radio frequency plasma display panel that is capable of lowering a discharge voltage and a method of fabricating the same are disclosed. In the radio frequency plasma display panel, each of a plurality of discharge cells includes a plurality of first and second electrode lines formed in such a manner that they cross each other with having a dielectric layer therebetween for causing a discharge. An auxiliary electrode is formed at any one of the first and second electrode lines for each discharge cell to position the first and second electrode lines in parallel to each other within the discharge cell.

27 Claims, 15 Drawing Sheets

RADIO FREQUENCY PLASMA DISPLAY PANEL AND FABRICATING METHOD THEREOF AND DRIVING APPARATUS THEREFOR

BACKGROUND OF THE INVENTION

1. Field of the Invention

This invention relates to a plasma display panel, and more particularly to a plasma display panel driven with a radio frequency, hereinafter referred to as "radio frequency PDP", that is capable of lowering a discharge voltage and a method of fabricating the same. Also, the present invention is directed to a radio frequency PDP that is capable of preventing a cross talk between cells and a method of fabricating the same. Furthermore, the present invention is directed to a driving apparatus for the radio frequency PDP.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current (AC) driving system.

Since the AC-type PDP has an advantage of a low voltage driving and a long life in comparison to the DC-type PDP, it will be highlighted as the future display device. The AC-type PDP allows an alternating voltage signal to be applied between electrodes having dielectric layer therebetween to generate a discharge every half-period of the signal, thereby displaying a picture. Such an AC-type PDP uses a dielectric material that allows a wall charge to be accumulated on the surface thereof upon discharge.

Referring to FIG. 1 and FIG. 2, the AC-type PDP includes a front substrate 1 provided with a sustaining electrode pair 10, and a rear substrate 2 provided with address electrodes 4. The front substrate 1 and the rear substrate 2 are spaced in parallel to each other with having barrier ribs 3 therebetween. A mixture gas, such as Ne—Xe or He—Xe, etc., is injected into a discharge space defined by the front substrate 1, the rear substrate 2 and the barrier ribs 3. The sustaining electrode pair 10 makes a pair by two within a single of plasma discharge channel. Any one electrode of the sustaining electrode pair 10 is used as a scanning/sustaining electrode that responds to a scanning pulse applied in an address interval to cause an opposite discharge along with the address electrode 4 while responding to a sustaining pulse applied in a sustaining interval to cause a surface discharge with the adjacent sustaining electrodes 10. Also, the sustaining electrode 10 adjacent to the sustaining electrode 10 used as the scanning/sustaining electrode is used as a common sustaining electrode to which a sustaining pulse is applied commonly. On the front substrate 1 provided with the sustaining electrodes 10, a dielectric layer 8 and a protective layer 9 are disposed. The dielectric layer 8 is responsible for limiting a plasma discharge current as well as accumulating a wall charge during the discharge. The protective film 9 prevents a damage of the dielectric layer 8 caused by the sputtering generated during the plasma discharge and improves the emission efficiency of secondary electrons. This protective film 9 is usually made from MgO. The rear substrate 2 is provided with a dielectric thick film 6 covering the address electrodes 4. The barrier ribs 3 for dividing the discharge space are extended perpendicularly at the rear substrate 2. On the surfaces of the rear substrate 2 and the barrier ribs 3, a fluorescent material 5 excited by a vacuum ultraviolet lay to generate a visible light is provided.

In such an AC-type PDP, one frame consists of a number of sub-fields so as to realize gray levels by a combination of the sub-fields. For instance, when it is intended to realize 256 gray levels, one frame interval is time-divided into 8 sub-fields. Further, each of the 8 sub-fields is again divided into a reset interval, an address interval and a sustaining interval. The entire field is initialized in the reset interval. The cells on which a data is to be displayed are selected by a writing discharge in the address interval. The selected cells sustain the discharge in the sustaining interval. The sustaining interval is lengthened by an interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields.

In the AC-type PDP, a sustaining pulse having a duty ratio of 1, a frequency of 200 to 30 kHz and a pulse width of 10 to 20 μs is alternately applied to the sustaining electrode pair 10. The sustaining discharge occurring between the sustaining electrode pair 10 in response to the sustaining pulse is generated only once at an extremely short instance. Charged particles produced by the sustaining discharge moves through a discharge path between the sustaining electrode pair 10 in accordance with the polarity of the sustaining electrode pair 10 to be accumulated on an upper dielectric layer 14 and thus be left into a wall charge. This wall charge lowers a driving voltage during the next sustaining discharge, but it reduces an electric field at a discharge space during the corresponding sustaining discharge. Thus, if a wall charge is formed during the sustaining discharge, then a discharge is stopped. As mentioned above, the sustaining discharge is generated only once at a much shorter instance than a width of the sustaining pulse, the majority of sustaining discharge time is wasted for a preparation step for the wall charge formation and the next sustaining discharge. For this reason, since the conventional AC-type PDP has a much shorter real discharge interval than the entire discharge interval, it has a low brightness and low discharge efficiency.

In order to solve the above-mentioned low brightness and discharge efficiency problem in the AC-type PDP, there has been suggested a radio frequency PDP, hereinafter referred to as "RFPDP", for exploiting a radio frequency signal of tens of to hundreds of MHz to cause the sustaining discharge. In the RFPDP, electrons make a vibrating motion within the cell by the radio frequency discharge.

Referring now to FIG. 2, the RFPDP includes a rear substrate 12 formed in such a manner that an address electrode 14 is perpendicular to a scanning electrode 18, and a front substrate 30 formed in such a manner that a radio frequency electrode 28 is parallel to the scanning electrode 18. Between the address electrode 14 and the scanning electrode 18, a first lower dielectric layer 16 for insulation between these electrodes is provided. A second lower dielectric layer 20 and a protective film 22 are disposed on the scanning electrode 18. A lattice-shaped barrier rib 24 is formed on the protective film 22. The surface of the lattice-shaped barrier rib 24 is coated with a florescent material 26. An upper dielectric layer 29 is formed evenly on the front substrate 30 provided with a radio frequency electrode 28.

The RFPDP displays a picture by a combination of a number of sub-fields, each of which includes a reset interval, an address interval and a sustaining interval. In the reset interval, the entire field is initialized. Next, in the address interval, a data pulse and a scanning pulse are applied to the address electrode 14 and the scanning electrode 18, respectively, to select cells by a discharge between the address electrode 14 and the scanning electrode 18. The selected cells display a picture by the vibration motion of electrons in the sustaining interval. At this time, a radio frequency signal of several to tens of MHz is applied to the radio frequency electrode 28, and a radio frequency of direct current bias voltage is applied to the scanning electrode 18. By this radio frequency signal, electrons within the cells make a vibration motion within the discharge space in accordance with the polarity of the radio frequency signal. The vibration motion of electrons successively ionizes a discharge gas. A vacuum ultraviolet ray generated by such a discharge excites a fluorescent material 26 to generate a visible light upon transition of the fluorescent material 26. As described above, the RFPDP exploits a radio frequency signal to cause a discharge continuously during the sustaining interval, so that it can obtain higher brightness and higher discharge efficiency in comparison to the AC-type PDP.

However, the conventional RFPDP has a problem in that, since the address electrode 14 and the scanning electrode 18 are positioned at a different height with having dielectric layers 16 and 20 therebetween and the dielectric layers 16 and 20 have a large thickness as shown in FIG. 3, a large voltage drop is caused by the dielectric layers 16 and 20 existing in a discharge path 32 during the writing discharge. In other words, a writing voltage applied to the address electrode 14 and the scanning electrode 18 is lowered as much as a magnitude of the voltage drop caused by the thickness of the dielectric layers 16 and 20. As a result, there can occur an unstable writing discharge. If a writing voltage is raised so as to stabilize the writing discharge, then a discharge field generated upon writing discharge is diffused to the adjacent cells along the address electrode 14 or the scanning electrode 18 to cause a cross talk between the cells. The generation of a cross talk between the cells causes a miss discharge. Also, if a writing voltage is raised, then the manufacturing cost and the power consumption increase because a driving circuit is implemented with the high voltage circuit devices.

SUMMARY OF THE INVENTION

Accordingly, it is an object of the present invention to provide a radio frequency plasma display panel that is capable of lowering a discharge voltage and a method of fabricating the same.

A further object of the present invention is to provide a driving apparatus for the above-mentioned radio frequency plasma display panel.

In order to achieve these and other objects of the invention, a radio frequency plasma display panel according to one aspect of the present invention includes a plurality of discharge cells including a plurality of first electrode lines and a plurality of second electrodes lines, being formed in such a manner that they cross each other with having a dielectric layer therebetween, for causing a discharge; and an auxiliary electrode formed at any at least one of the first and second electrode lines for each discharge cell to arrange the first and second electrode lines in parallel to each other within the discharge cell.

A method of fabricating a radio frequency plasma display panel according to another aspect of the present invention includes the steps of: forming a plurality of first electrode lines on a substrate; forming a first auxiliary electrode protruded from the first electrode line spaced with having a desired distance therebetween; entirely coating a first dielectric material to cover the first auxiliary electrode and the first electrode lines; and forming a plurality of second electrode lines perpendicular to the first electrode lines.

A driving apparatus for a radio frequency plasma display panel according to still another aspect of the present invention includes an auxiliary electrode provided at any at least one of a scanning electrode and an address electrode for each discharge cell to position the scanning electrode and the address electrode in parallel to each other within a discharge cell; a radio frequency signal driver for applying a radio frequency signal having a higher frequency than a commercial alternating current voltage to the radio frequency electrode; and a pulse signal driver for applying a scanning pulse and a data pulse having a frequency of the commercial alternating current voltage to the scanning electrode and the address electrode, respectively.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
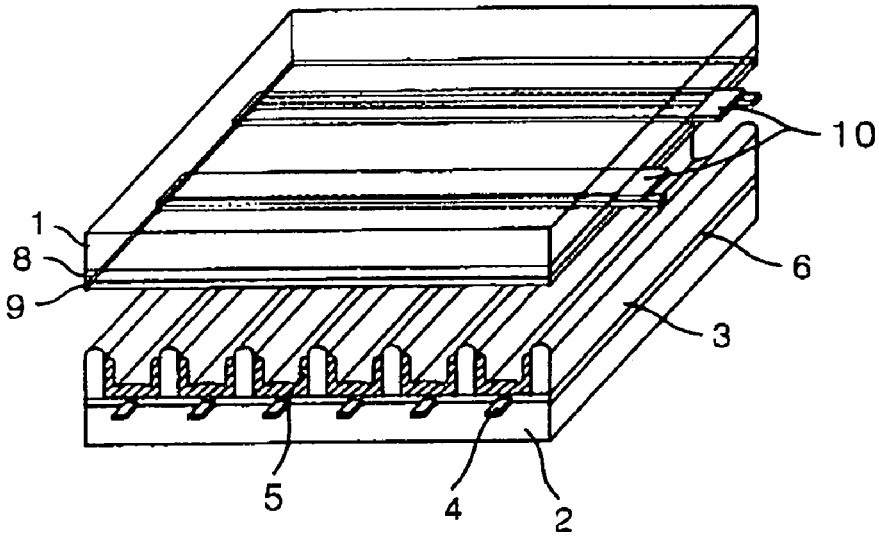
FIG. 1 RELATED ART
FIG. 1 is a schematic perspective view showing the structure of a conventional AC-type plasma display panel.
Figure 2:
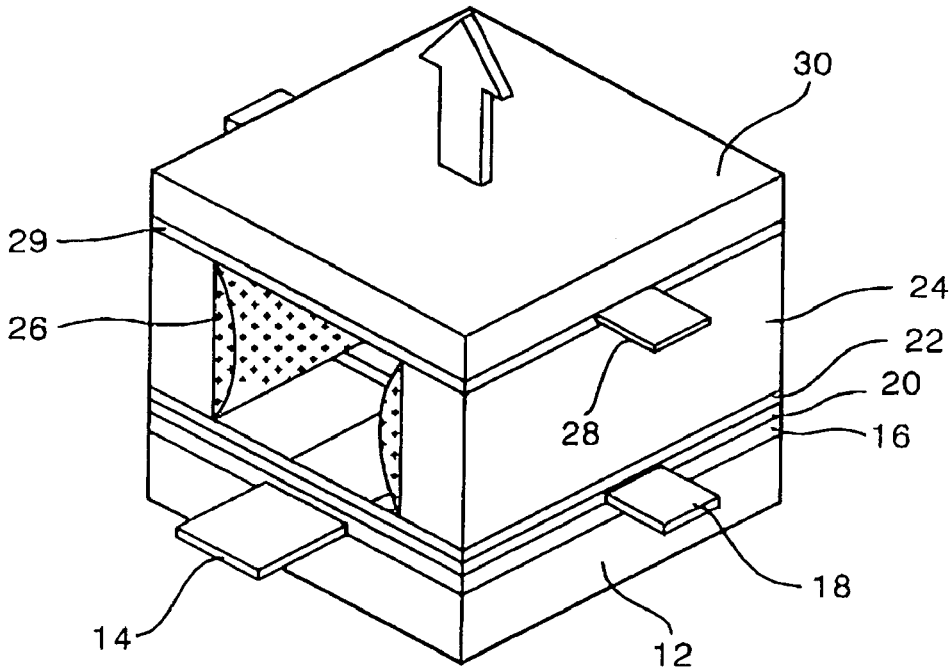
FIG. 2 RELATED ART
FIG. 2 is a plan view showing the structure of a conventional radio frequency PDP.
Figure 3:
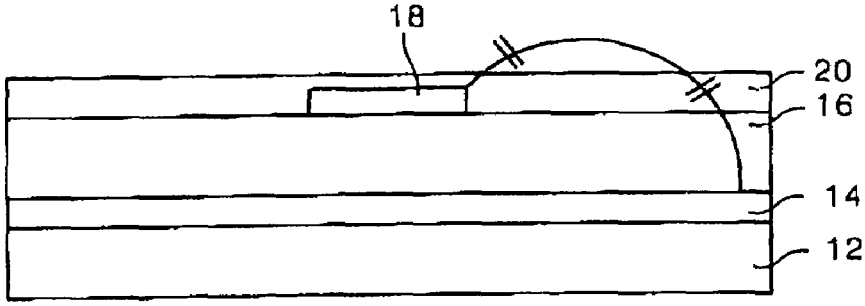
FIG. 3 RELATED ART
FIG. 3 is a section view of the lower plate for representing a light path during the writing discharge of the radio frequency PDP shown in FIG. 2.
Figure 4:
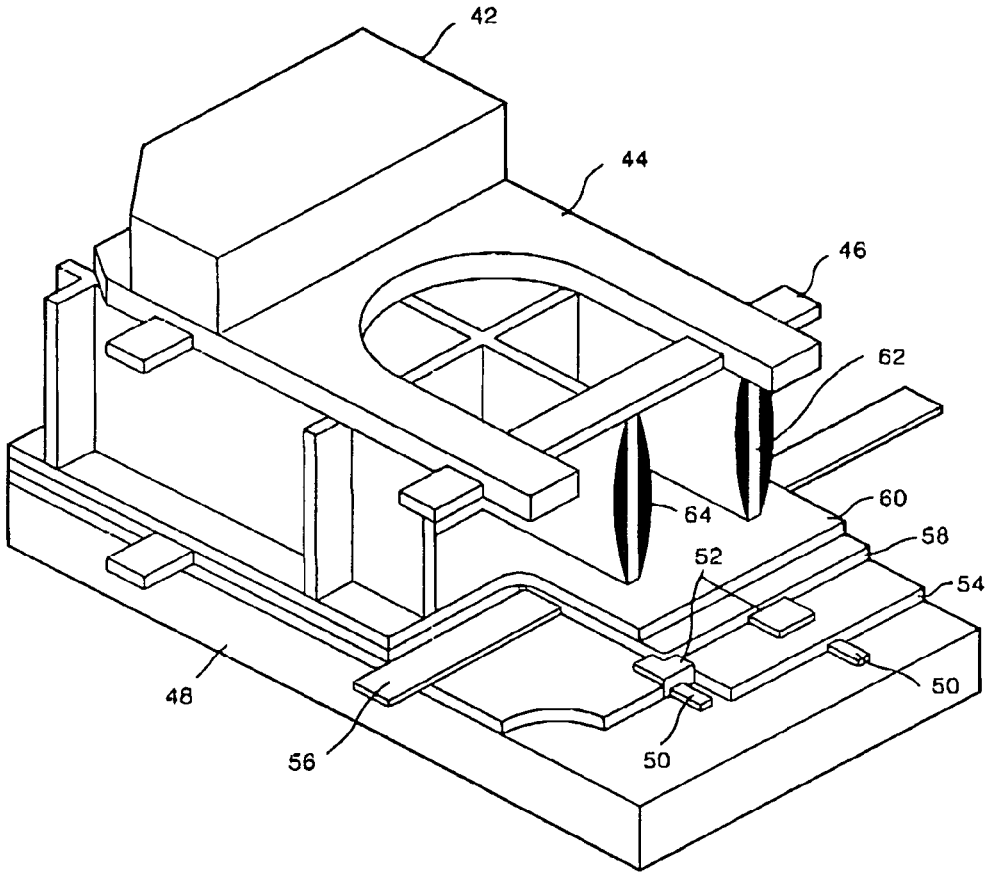
FIG. 4 is a fractional cut-away perspective view showing the structure of a radio frequency PDP according to an embodiment of the present invention.
Figure 5:
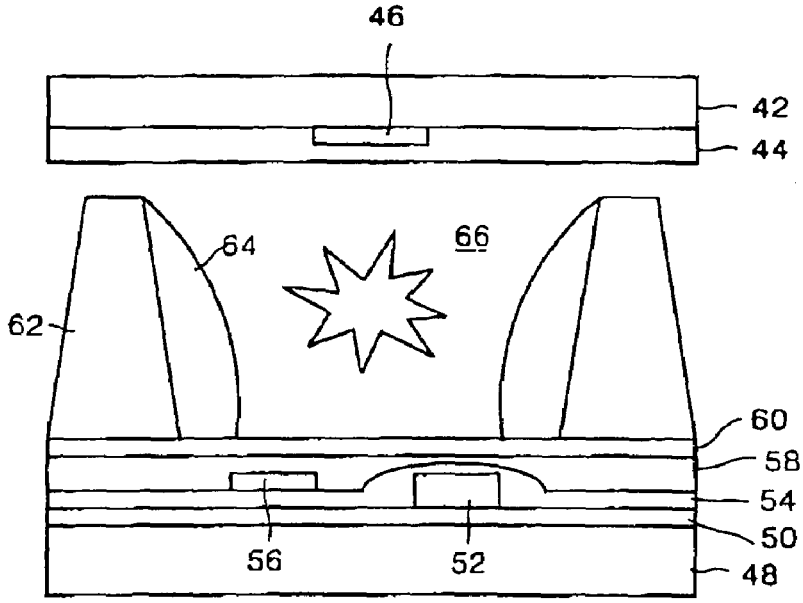
FIG. 5 is a section view of the radio frequency PDP shown in FIG. 4.

Referring to FIG. 4 and FIG. 5, there is shown a radio frequency plasma display panel (RFPDP) according to an embodiment of the present invention. The RFPDP includes a rear substrate 48 formed in such a manner that address electrodes 50 are perpendicular to scanning electrodes 56, auxiliary electrodes 52 protruded from the address electrodes 50 at a position adjacent to each intersection between the address electrodes 50 and the scanning electrodes 56, and a front substrate 42 having radio frequency electrode 46 formed in parallel to the scanning electrodes 56. Between the address electrode 50 and the scanning electrode 56, a first lower dielectric layer 54 is provided. The first lower dielectric layer 54 serves an insulation layer between the scanning electrode 56 and the address electrode 50. A second lower dielectric layer 58 and a protective film 60 are disposed on the scanning electrode 56 and the first lower dielectric layer 54. A lattice-shaped barrier rib 62 is formed on the protective film 60. The surface of the lattice-shaped barrier rib 62 is coated with a florescent material 64. A mixture gas of Ne–Xe and He–Xe, etc. is injected into a discharge space 66 provided among the front substrate 42, the rear substrate 48 and the barrier rib 62.

The address electrode 50 and the scanning electrode 56 are coupled with a data pulse and a scanning pulse synchronized in the address interval, respectively. At this time, a writing discharge is generated between the auxiliary electrode 52 and the scanning electrode 56. The radio frequency electrode 46 is supplied with a radio frequency signal to make a radio frequency sustaining discharge of cells selected by the writing discharge. The scanning electrode 56 is supplied with a bias voltage for the radio frequency signal applied to the radio frequency electrode 46 during the radio frequency sustaining discharge. A ultraviolet ray generated by such a radio frequency sustaining discharge excites the fluorescent material 64 to produce a visible light which is any one of red, green and blue colors.

Figure 6A:
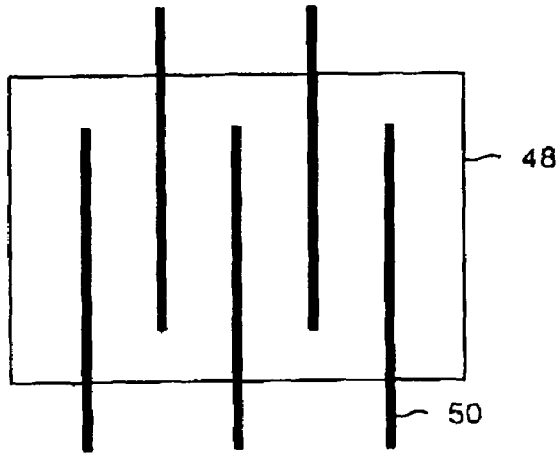
FIG. 6A to FIG. 6G are views for representing a method of fabricating the lower plate of the radio frequency PDP shown in FIG. 4.
Figure 6B:
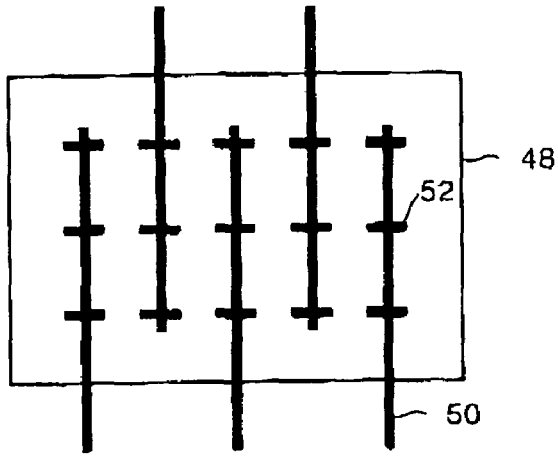
Figure 6C:
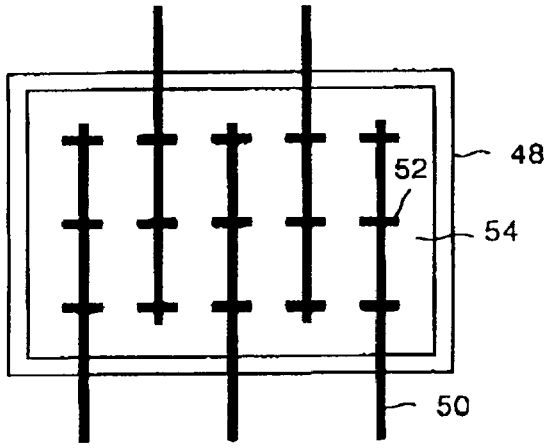
Figure 6D:
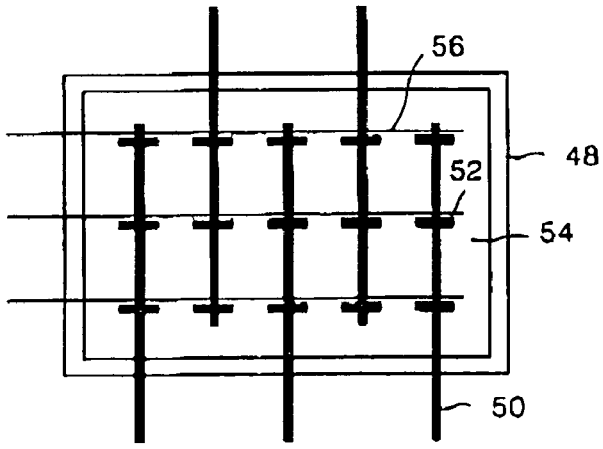
Figure 6E:
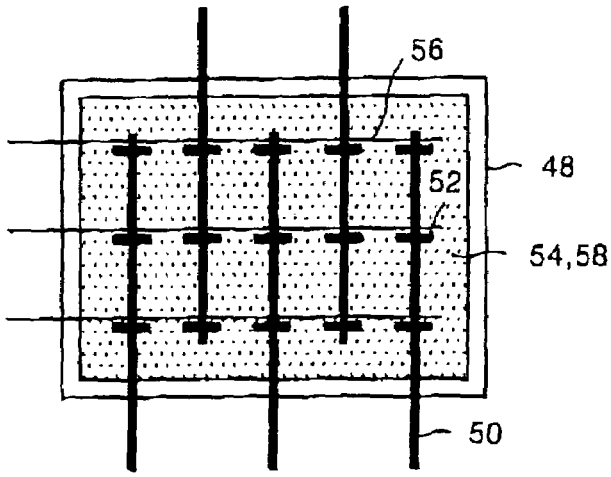
Figure 6F:
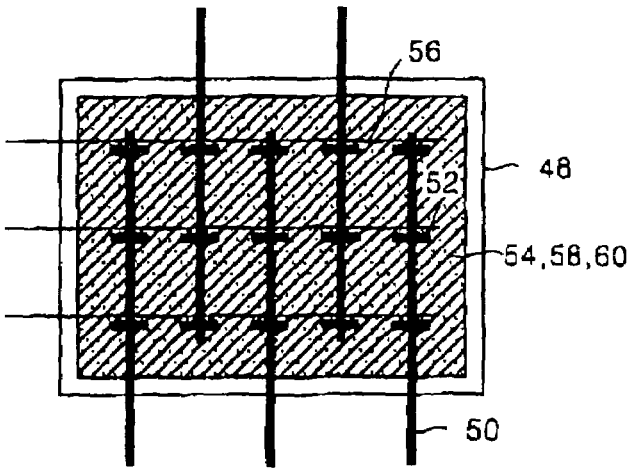
Figure 6G:
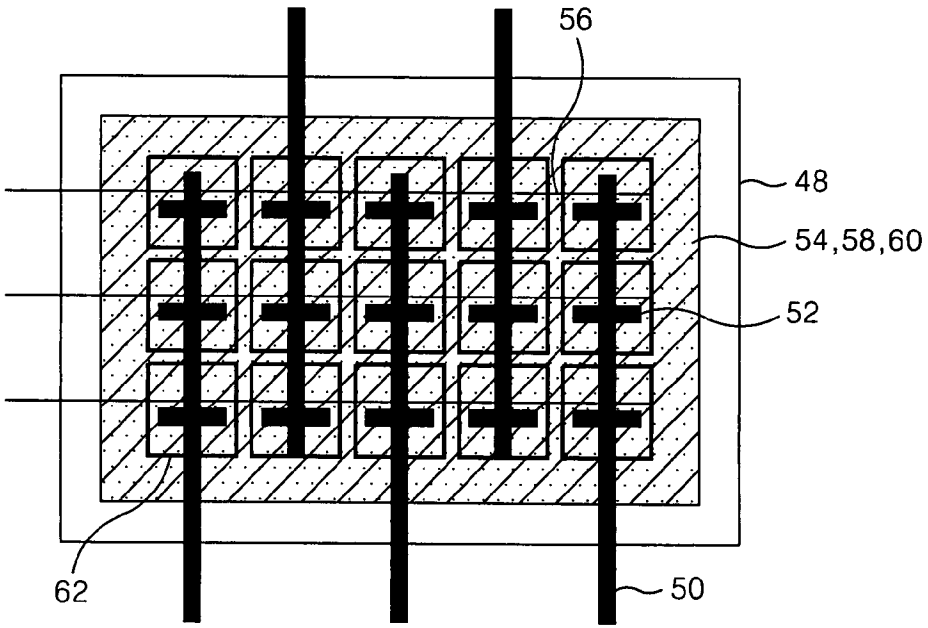

FIGS. 6A to 6G show a method of fabricating the lower plate of the RFPDP shown in FIG. 4 and FIG. 5 step by step. Referring to FIG. 6A, the address electrode 50 made from a metal is formed on the rear substrate 48 by the vacuum vapor deposition technique such as the sputtering. Next, as shown in FIG. 6B, the auxiliary electrode 52 made form a metal is formed on the address electrode 50 with having a desired distance therebetween by the vacuum vapor deposition technique. The rear substrate 48 provided with the address electrode 50 and the auxiliary electrode 52 is entirely coated with a dielectric material by the screen printing technique as shown in FIG. 6C. The first dielectric layer 54 formed in this manner covers the address electrode 50 and the auxiliary electrode 52. The first dielectric layer 54 covered on the auxiliary electrode 52 has a much smaller thickness than that covered on the address electrode 50. As shown in FIG. 6D, the scanning electrode 56 made from a metal is formed on the first dielectric layer 50 in a direction perpendicular to the address electrode 50. The scanning electrode 56 is located at the same height as the auxiliary electrode 52. A parasitic capacitance formed between the scanning electrode 56 and the auxiliary electrode 52 can be adjusted by controlling a distance between the scanning electrode 56 and the auxiliary electrode 52. As shown in FIG. 6E, a dielectric material is entirely coated on the first dielectric layer 50 provided with the scanning electrode 56 by the screen printing technique. As shown in FIG. 6F, the protective film 60 made from MgO is entirely deposited on the second dielectric layer 58 formed in this manner. As shown in FIG. 6G, the lattice-shaped barrier rib 62 is formed on the protective film 60 using the screen printing technique, the sand blast technique or the photo-sensitive glass. The surface of the barrier rib 62 is coated with the fluorescent material 64.

Figure 7:
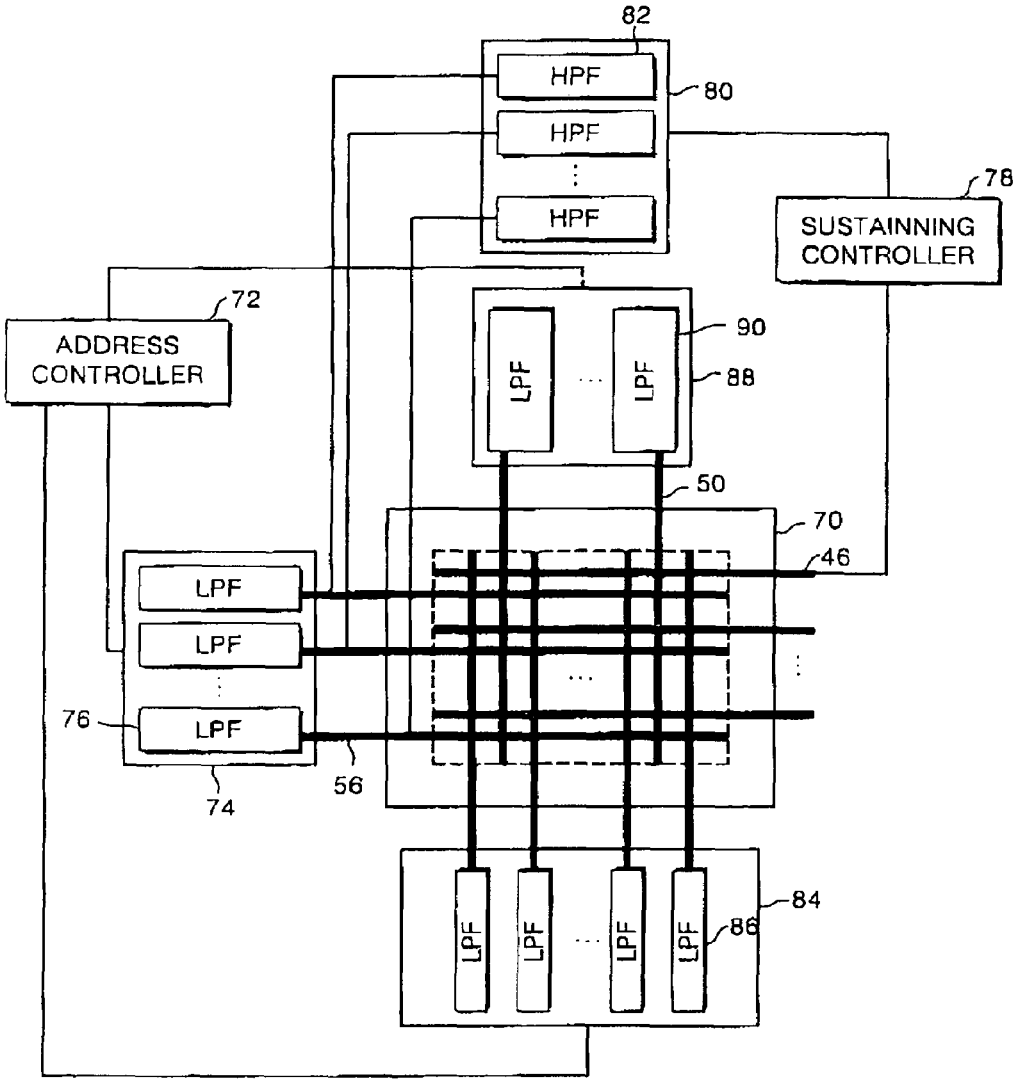
FIG. 7 is a block diagram showing the configuration of a driving circuit of the radio frequency PDP shown in FIG. 4.

FIG. 7 is a schematic block diagram showing the configuration of a driver of the RFPDP shown in FIG. 4 and FIG. 5. In FIG. 7, the driver of the RFPDP includes low pass filters (LPF's) 74, 84 and 88 connected to the scanning electrodes 56 and the address electrodes 50 of the RFPDP 70 to generate a low frequency of alternating current pulse, an address controller 72 connected to the low pass filters 74, 84 and 88 to control a writing discharge, a high pass filter (HPF) 80 connected to the scanning electrode 56 of the RFPDP 70 to generate a high frequency signal, and a sustaining controller 78 connected between the high pass filter 80 and the radio frequency electrode 46 to control a radio frequency sustaining discharge. Each of the LPF's 74, 88 and 84 plays a role to filter a signal inputted from the scanning electrode 56 and the address electrode 50 into a low frequency band. To this end, each LPF 74, 88 and 84 consists of a plurality of low pass filters connected, in series, to the scanning electrode 56 and the address electrode 50. The address controller 72 plays a role to apply a data pulse and a scanning pulse synchronized with each other to the LPF's 88 and 84 connected to the address electrode 50 and to the LPF 74 connected to the scanning electrode 56, respectively. The HPF 82 extracts a radio frequency band signal from a signal inputted from the scanning electrode 56 to apply it to the sustaining controller 76. To this end, the HPF 82 consists of a plurality of high pass filters connected, in series, to the scanning electrode 56. The sustaining controller 78 plays a role to commonly apply a radio frequency signal inputted from the HPF 82 to all of the radio frequency electrodes 46. The LPF 74 and the HPF 82 connected, in parallel, to the scanning electrode 56 are commonly connected via the scanning electrode 56, but have a different pass band. For this reason, the address controller 72 is not influenced by a radio frequency signal while the sustaining controller 76 is not influenced by a low frequency signal.

Figure 8:
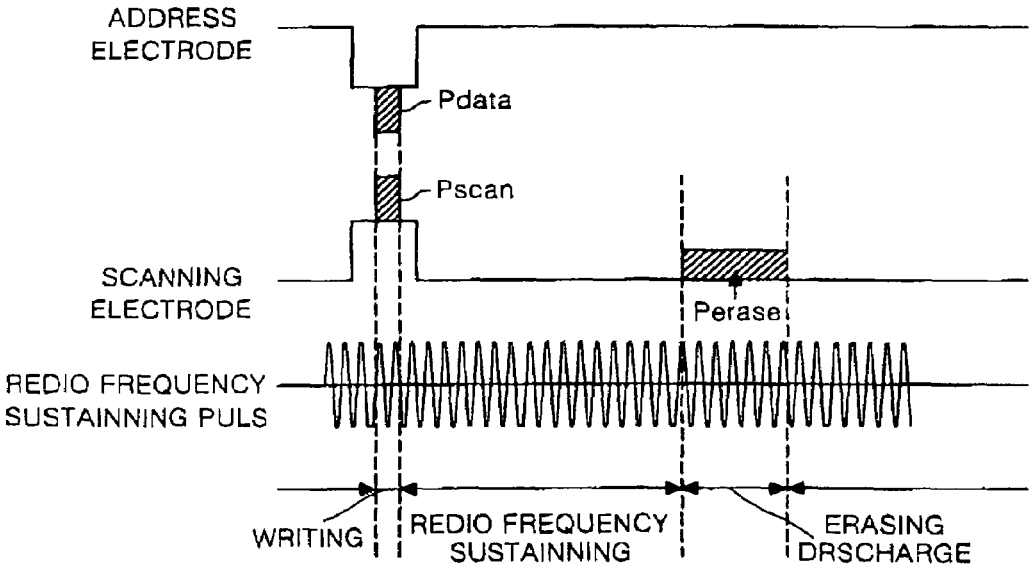
FIG. 8 is a waveform diagram of a driving signal applied to each electrode in the radio frequency PDP shown in FIG. 4.
Figure 9:
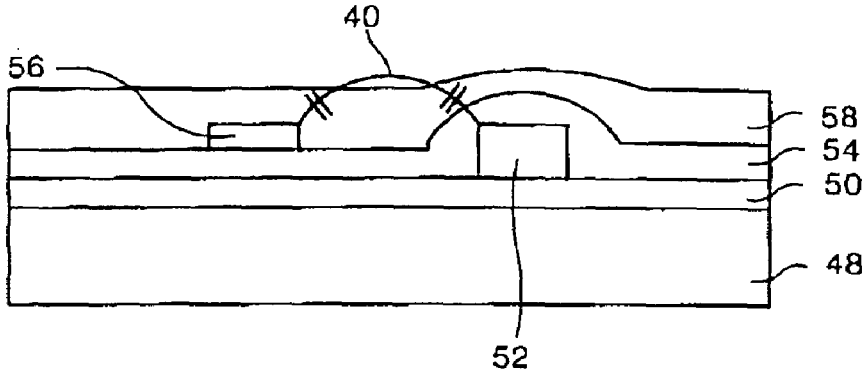
FIG. 9 is a section view of the lower plate for representing a light path during the writing discharge of the radio frequency PDP shown in FIG. 4.
Figure 10:
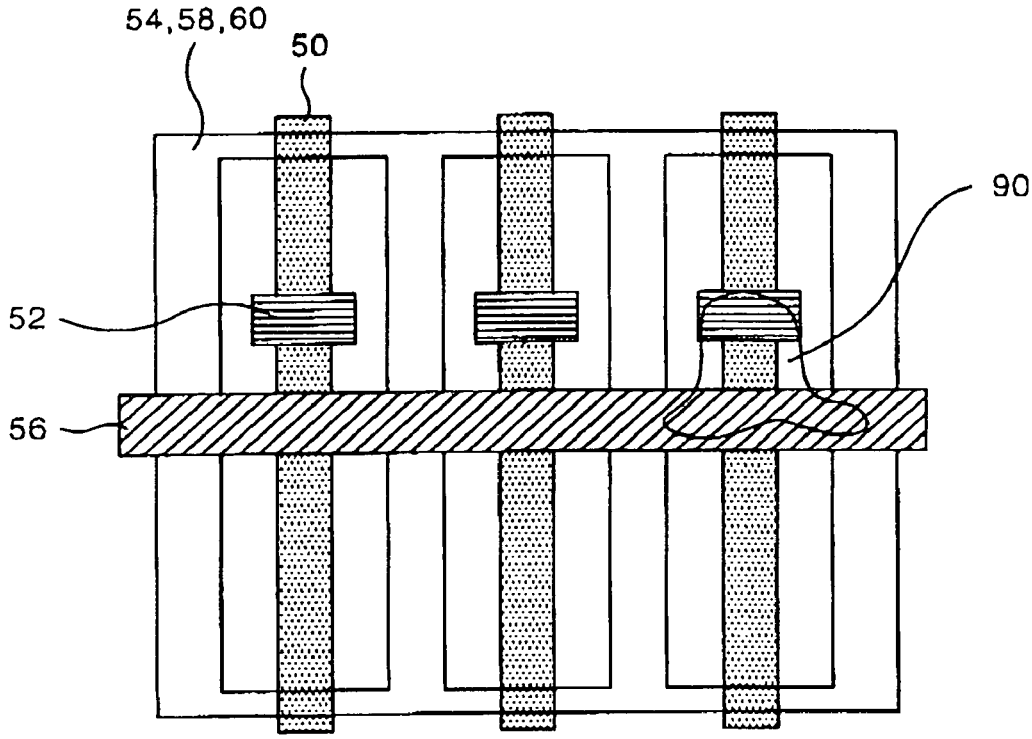
FIG. 10 is a plan view representing a distribution of a discharge field during the writing discharge of the radio frequency PDP shown in FIG. 4.

FIG. 8 is a waveform diagram for representing a method of driving the RFPDP shown in FIG. 4 and FIG. 5. Referring to FIG. 8, a data pulse Pdata and a scanning pulse Pscan synchronized with each other are applied to the address electrode 50 and the scanning electrode 56, respectively, by means of the address controller 72. Then, since a discharge distance between the scanning electrode 56 and the address electrode 50 is shorter than that between the scanning electrode 56 and the auxiliary electrode 52, a writing discharge occurs on the same plane between the scanning electrode 56 and the auxiliary electrode 52. Since the dielectric layer 58 with a smaller thickness than the conventional dielectric layers only exists in the discharge path 40 as shown in FIG. 9, a thickness of the dielectric material on the discharge path 40 becomes thin. Accordingly, as a voltage drop value is reduced as much as the thinned thickness of the dielectric material, a voltage required for the writing discharge is lowered to that extent. As seen from FIG. 10, a discharge field 90 generated by the writing discharge is limited only between the scanning electrode 56 and the auxiliary electrode 52. Since the discharge field 90 is limited within the cell area as described above, a miss discharge of the adjacent cells due to a diffusion of the discharge field 90 is not generated. When the writing discharge has been generated in this manner, charged particles involving electrons are produced within the selected cell.

During the writing discharge, a radio frequency signal is continuously applied to the radio frequency electrode 46 to apply a radio frequency electric field to the discharge space 66 between the radio frequency electrode 46 and the scanning electrode 56. Thus, charged particles produced during the writing discharge, particularly, electrons having a light mass make a vibration motion by the radio frequency electric field to cause a radio frequency sustaining discharge. Since the polarity of a radio frequency signal is inverted before electrons collide with the dielectric layers 44 and 58 during the radio frequency sustaining discharge, the electrons make a vibration motion only within the discharge space 66. The electrons making a vibration motion in this manner continuously excite a discharge gas within the discharge space 66. An ultraviolet ray generated at this time excites the fluorescent material 64, thereby allowing the fluorescent material to generate a visible light. After the radio frequency sustaining discharge was sustained in a desired time interval, a positive polarity of erasing pulse Perase is applied to the scanning electrode 56. Then, the radio frequency electric field is disturbed to terminate the radio frequency sustaining discharge.

Figure 11:
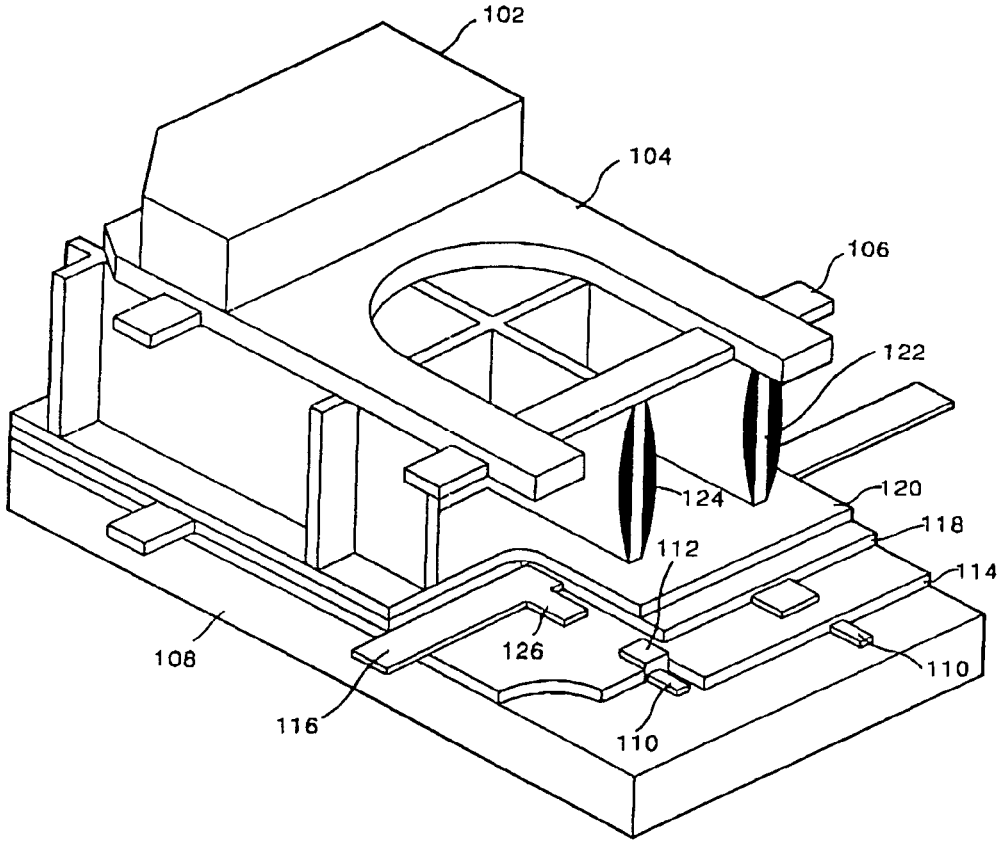
FIG. 11 is a fractional cut-away perspective view showing the structure of a radio frequency PDP according to another embodiment of the present invention.
Figure 12:
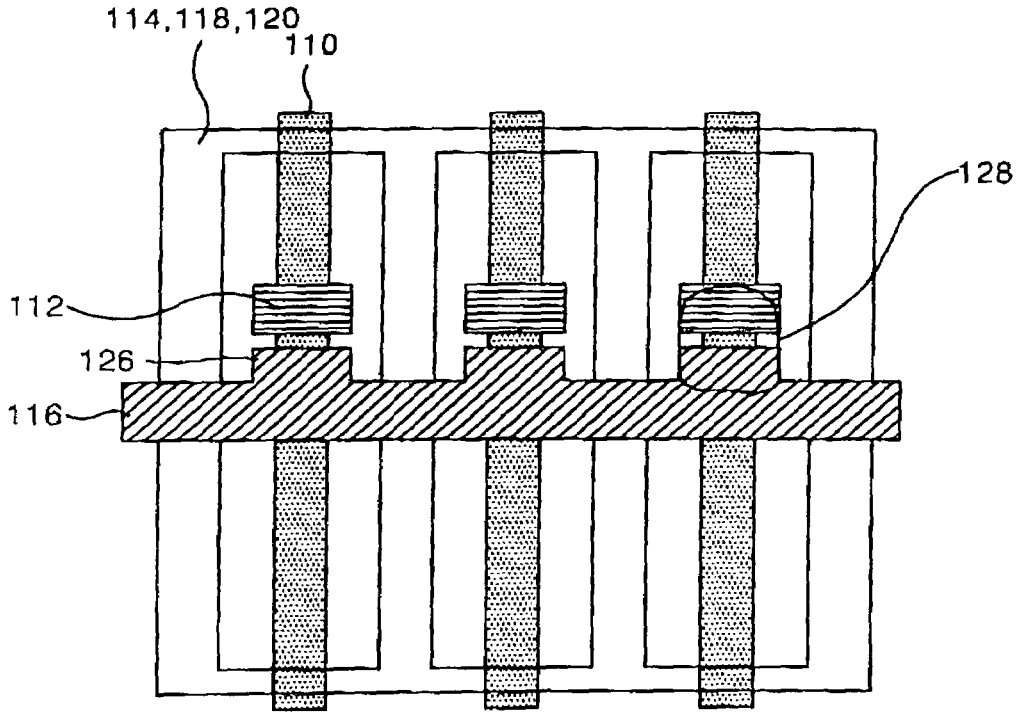
FIG. 12 is a plan view representing a distribution of a discharge field during the writing discharge of the radio frequency PDP shown in FIG. 11.

Referring to FIG. 11, there is shown a radio frequency PDP according to another embodiment of the present invention. The radio frequency PDP includes a rear substrate 108 formed in such a manner that address electrodes 110 are perpendicular to scanning electrode 116, first auxiliary electrodes 112 protruded from the address electrodes 110 at a position adjacent to each intersection between the address electrodes 110 and the scanning electrodes 116, second auxiliary electrodes 126 protruded toward the first auxiliary electrodes 112 from the scanning electrodes 116, and a front substrate 102 having radio frequency electrodes 106 arranged in parallel to the scanning electrodes 116. The first and second auxiliary electrodes 112 and 126 is located on the same plane to cause a writing discharge when a scanning pulse and a data pulse are applied to the scanning electrodes 116 and the address electrodes 110, respectively. In this case, the first and second auxiliary electrodes 112 and 126 shorten a discharge path during the writing discharge. Accordingly, the majority of a discharge field 128 generated during the writing discharge is produced between the first and second auxiliary electrodes 112 and 126 as shown in FIG. 12. Accordingly, a distribution of the discharge field 128 is more limited to the center of the cell in comparison to the RFPDP shown in FIG. 4. A writing voltage required for the writing discharge is reduced to such an extent that a thickness of the dielectric material at the discharge path becomes thin and a distance between the electrodes becomes narrow by positioning first and second auxiliary electrodes 112 and 126 on the same plane.

A process of fabricating the RFPDP shown in FIG. 11 will be described below. First, the address electrodes 110 are formed on the rear substrate 108, and the first auxiliary electrodes 112 are formed thereon. The first auxiliary electrodes 110 are spaced by a cell pitch from each other. The rear substrate 108 provided with the address electrodes 110 and the first auxiliary electrodes 112 is entirely coated with a dielectric material to form the first dielectric layer 114. On the first dielectric layer 114, the scanning electrodes and the second auxiliary electrodes 126 are provided by exploiting the same mask pattern. The second dielectric layer 118 and a protective film 120 are disposed on the first dielectric layer 114 provided with the scanning electrodes 116 and the second auxiliary electrodes 126. A lattice-shaped barrier rib 122 are formed on the protective film 120, and the surface of the barrier rib 122 is coated with a fluorescent material 124. Since the scanning electrodes 116 and the second auxiliary electrodes 126 are simultaneously patterned as seen from the above-mentioned fabrication process, the number of the fabrication process of the RFPDP shown in FIG. 11 becomes equal to that of the RFPDP shown in FIG. 4.

As described above, according to the present invention, the auxiliary electrodes are formed on the scanning electrodes and/or the address electrodes in such a manner that the scanning electrodes and the address electrodes crossing each other on the rear substrate is arranged in parallel to each other. Thus, since the scanning electrodes and the address electrodes causing a writing discharge with the aid of the auxiliary electrodes are positioned in parallel, a thickness of the dielectric material existing in the discharge paths of the scanning electrodes and the address electrodes becomes thin and a distance between the electrodes becomes narrow. Accordingly, a discharge voltage for causing a discharge between the scanning electrodes and the address electrodes is lowered. The distance between the scanning electrodes and the address electrodes becomes narrow by means of the auxiliary electrodes to concentrate the distribution of the discharge field on the center of the cell, so that a cross talk between the cells caused by the discharge field diffused into the adjacent cells along the scanning electrodes or the address electrodes can be prevented. Furthermore, the driving apparatus for the RFPDP according to the present invention includes the low pass filters at the scanning electrodes and the address electrodes and the high pass filters between the scanning electrodes and the radio frequency electrodes so that it can apply a radio frequency signal with a higher frequency than a commercial alternating current voltage to the radio frequency electrodes by a simple frequency band filtering and that it can apply a pulse signal with a frequency of the commercial alternating current voltage to the scanning electrodes and the address electrodes.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A radio frequency plasma display panel, comprising:

a plurality of discharge cells including a plurality of first electrode lines and a plurality of second electrode lines, being formed in such a manner that they cross each other with a dielectric layer therebetween, for causing a discharge; and a first auxiliary electrode formed at least one of the first or second electrode lines for each discharge cell, wherein the first auxiliary electrode is directly connected to at least one of the first or second electrode lines.

2. The radio frequency plasma display panel as claimed in claim 1, wherein the first electrode lines are address electrodes formed on a substrate, and the second electrode lines are scanning electrodes formed on the dielectric layer covering the address electrodes.

3. The radio frequency plasma display panel as claimed in claim 2, wherein the first auxiliary electrode is located on the address electrode to be perpendicular to the address electrode at a position adjacent to an intersection between the address electrode and the scanning electrode, and is arranged parallel to the scanning electrode.

4. The radio frequency plasma display panel as claimed in claim 2, wherein the first auxiliary electrode is located on the address electrode to be perpendicular to the address electrode at a position adjacent to an intersection between the address electrode and the scanning electrode and is arranged parallel to the scanning electrode; and a second auxiliary electrode is located on the scanning electrode and protrudes toward the first auxiliary electrode therefrom.

5. The radio frequency plasma display panel as claimed in claim 2, wherein the dielectric layer includes:

a first dielectric layer formed between the address electrode and the scanning electrode in each discharge cell; and a second dielectric layer covering the first auxiliary electrode and the scanning electrode.

6. The radio frequency plasma display panel as claimed in claim 1, further comprising:

a first substrate provided with the first and second electrode lines and the first auxiliary electrode;

a radio frequency electrode coupled with a radio frequency signal with a higher frequency than a predetermined alternating current voltage to cause a radio frequency discharge along with at least one of the first or second electrode lines;

a second substrate provided with the radio frequency electrode and opposed to the first substrate;

a barrier rib formed perpendicularly between the first and second substrates; and a fluorescent material coated on the barrier rib.

7. The radio frequency plasma display panel as claimed in claim 1, wherein the second electrode line constitutes a second auxiliary electrode in such a manner that it is protruded toward the first auxiliary electrode.

8. A method of fabricating a radio frequency plasma display panel, comprising:

forming a plurality of first electrode lines on a substrate;

forming a first auxiliary electrode directly connected to one of the first electrode lines having a desired distance therebetween;

coating a first dielectric material to cover the first auxiliary electrode and said one of the first electrode lines; and forming a plurality of second electrode lines perpendicular to the first electrode lines.

9. The method as claimed in claim 8, further comprising:

forming a second auxiliary electrode protruded toward the first auxiliary electrode from a respective one of the second electrode lines;

coating a second dielectric material on the first dielectric material to cover said one of the second electrode lines and the second auxiliary electrode;

forming a protective film on the second dielectric material;

forming a barrier rib on the protective film; and coating a fluorescent material on the barrier rib.

10. The method as claimed in claim 9, wherein at least said one of the second electrode lines and the second auxiliary electrode are simultaneously patterned using a same mask pattern.

11. The method as claimed in claim 8, wherein the first dielectric material entirely covers the first auxiliary electrode and said one of the first electrode lines.

12. The method as claimed in claim 9, wherein the second dielectric material entirely covers said one of the second electrode lines and the second auxiliary electrode.

13. A driving apparatus for a radio frequency plasma display having discharge cells, each of which has a scanning electrode and an address electrode crossing each other with a dielectric layer therebetween on a first substrate to cause a writing discharge, and a radio frequency electrode formed on a second substrate opposed to the first substrate to cause a radio frequency sustaining discharge along with the scanning electrode, said driving apparatus comprising:

a first auxiliary electrode directly connected to at least one of the scanning electrode or the address electrode for each discharge cell;

a radio frequency signal driver for applying a radio frequency signal having a higher frequency than a predetermined alternating current voltage to the radio frequency electrode in each discharge cell; and a pulse signal driver for applying a scanning pulse and a data pulse having a frequency of the predetermined alternating current voltage to the scanning electrode and the address electrode, respectively.

14. The driving apparatus as claimed in claim 13, wherein the radio frequency signal driver includes:

a high pass filter connected to the scanning electrode to extract the radio frequency signal having a higher frequency than the predetermined alternating current voltage from a signal inputted from the scanning electrode; and a sustaining driver for applying the radio frequency signal to the radio frequency electrode.

15. The driving apparatus as claimed in claim 13, wherein the pulse signal driver includes:

a first low pass filter connected to the address electrode;

a second low pass filter connected to the scanning electrode; and an address driver, being commonly connected to the first and second low pass filters, for producing a pulse signal required for the writing discharge to control the writing discharge.

16. The driving apparatus as claimed in claim 13, wherein the first auxiliary electrode is located on the address electrode to be perpendicular to the address electrode at a position adjacent to an intersection between the address electrode and the scanning electrode, and is arranged parallel to the scanning electrode.

17. The driving apparatus as claimed in claim 13, wherein the first auxiliary electrode is located on the address electrode to be perpendicular to the address electrode at a position adjacent to an intersection between the address electrode and the scanning electrode and arranged parallel to the scanning electrode; and a second auxiliary electrode is located on the scanning electrode and protrudes toward the first auxiliary electrode therefrom.

18. A radio frequency plasma display panel, comprising:

a plurality of discharge cells, each including a first electrode and a second electrode, being formed on a first substrate in such a manner that they cross each other with a dielectric layer therebetween, for causing an address discharge; and a radio frequency electrode, arranged in parallel to the second electrode, formed on a second substrate opposite to the first substrate, for causing a radio frequency discharge; and an auxiliary electrode directly connected to the first electrode formed on the substrate, and formed in parallel to and on substantially the same plane as the second electrode via the dielectric layer.

19. A discharge cell, comprising:

a first electrode;

a second electrode that crosses the first electrode;

a dielectric layer positioned between the first and second electrode;

at least one auxiliary electrode directly connected to the first electrode and on substantially a same plane as the second electrode via the dielectric layer; and a radio frequency electrode poisoned and configured to cooperate with one of the first and second electrodes to cause a radio frequency discharge.

20. The discharge cell of claim 19, wherein the first electrode comprises an address electrode and the second electrode comprises a scanning electrode.

21. The discharge cell of claim 19, wherein the at least one auxiliary electrode further comprises a second auxiliary electrode connected to the second electrode.

22. The discharge cell of claim 21, wherein the second auxiliary electrode is directly connected to the second electrode and protrudes toward the auxiliary electrode.

23. A radio frequency plasma display panel comprising the discharge cell of claim 19.

24. A plasma display panel, comprising:

a first substrate;

a second substrate;

a plurality of discharge cells formed between the first and second substrate;

a plurality of first electrodes formed on the second substrate in a first direction;

a plurality of second electrodes formed in a second direction so as to cross the plurality of first electrodes;

a plurality of third electrodes associated with each of the first electrodes, wherein the plurality of third electrodes are directly connected to the plurality of first electrodes and wherein each of the plurality of third electrodes has a predetermined width and a predetermined length that runs in a direction substantially parallel to the second direction; and a plurality of fourth electrodes associated with each of the second electrodes, wherein each of the plurality of fourth electrodes is a radio frequency electrode having a predetermined width and predetermined length that runs in a direction substantially parallel to the second direction.

25. The plasma display panel of claim 24, wherein the plurality of fourth electrodes are electrically coupled to the plurality of second electrodes.

26. The plasma display panel of claim 25, wherein the plurality of fourth electrodes are electrically connected to the plurality of second electrodes.

27. The plasma display panel of claim 24, wherein the plurality of fourth electrodes are radio frequency electrodes positioned and configured to cooperate with the plurality of first electrodes or the plurality of second electrodes to cause a radio frequency discharge.

* * * * *